US009986844B2

(12) United States Patent
Shih

(10) Patent No.: US 9,986,844 B2
(45) Date of Patent: Jun. 5, 2018

(54) BRACKET FOR RETAINING MATTRESS AND BED EQUIPPED WITH THE SAME

(71) Applicant: Chuan-Hang Shih, Changhua County (TW)

(72) Inventor: Chuan-Hang Shih, Changhua County (TW)

( * ) Notice: Subject to any disclaimer, the term of this patent is extended or adjusted under 35 U.S.C. 154(b) by 187 days.

(21) Appl. No.: 14/737,144

(22) Filed: Jun. 11, 2015

(65) Prior Publication Data

US 2016/0360894 A1 Dec. 15, 2016

(51) Int. Cl.
*A47C 21/02* (2006.01)
*A47C 19/02* (2006.01)

(52) U.S. Cl.
CPC ..... *A47C 21/026* (2013.01); *A47C 19/02* (2013.01); *A47C 19/021* (2013.01)

(58) Field of Classification Search
CPC ..... A47C 21/00; A47C 21/02; A47C 21/022; A47C 21/024; A47C 21/026; A47C 21/028; A47C 19/02; A47C 19/021
See application file for complete search history.

(56) References Cited

U.S. PATENT DOCUMENTS 1,031,656 A * 7/1912 Mellon ..... A47C 21/026 5/193
1,371,098 A * 3/1921 Jones ..... A47C 21/026 5/193
3,474,473 A * 10/1969 Hannaberg ..... A47C 27/00 5/100
4,017,919 A * 4/1977 Hemmeter ..... A47C 21/026 5/411
4,297,754 A * 11/1981 Zuniga ..... A47C 21/026 5/411
4,554,692 A * 11/1985 Whitehead ..... A47C 19/025 248/916
5,195,200 A * 3/1993 Leoutsakos ..... A61G 7/053 5/503.1
5,400,450 A * 3/1995 Leoutsakos ..... A61G 7/053 5/426
5,448,791 A * 9/1995 Brown ..... A47C 21/00 5/425
5,471,689 A * 12/1995 Shaw ..... A61G 7/0536 5/426
D379,283 S * 5/1997 Antinori ..... 5/411
5,737,783 A * 4/1998 Antinori ..... A47C 21/026 248/300

(Continued)

*Primary Examiner* — David E Sosnowski
*Assistant Examiner* — David R Hare
(74) *Attorney, Agent, or Firm* — Muncy, Geissler, Olds & Lowe, P.C.

(57) ABSTRACT

An easily assembled bracket, adapted for being installed at an edge of a bed frame for retaining a mattress on the bed frame includes a fastener and a retainer. The fastener has two wings booth located on an imaginary plane, and a convex protruded from the imaginary plane. A passage is provided between the convex and a top surface of the bed frame. The retainer has an inserting portion detachably inserted in the passage, two stop portions extending from the inserting portion in two adverse directions respectively and abutted against an end of the convex, two extending portions extending from the two stop portions respectively, and at least one retaining portion connected with at least one of the extending portions for being abutted against a side of the mattress.

10 Claims, 6 Drawing Sheets

(56) References Cited

U.S. PATENT DOCUMENTS

| | | | | |
|---|---|---|---|---|
| 6,374,440 | B1 * | 4/2002 | Thim, Jr. | A47C 20/027 5/426 |
| 6,401,280 | B1 * | 6/2002 | Baker | A47C 21/08 5/426 |
| 6,834,403 | B1 * | 12/2004 | Elliott | A61G 7/0501 5/426 |
| 7,137,158 | B2 * | 11/2006 | Flannery | A47C 21/08 5/425 |
| 7,607,181 | B1 * | 10/2009 | Harrison | A47C 21/026 5/411 |
| 8,646,130 | B2 * | 2/2014 | Alzoubi | A47C 20/04 5/193 |
| 8,769,739 | B1 * | 7/2014 | McCarty | A47C 21/026 5/193 |
| 8,776,294 | B1 * | 7/2014 | McCarty | A47C 21/026 5/193 |
| 8,800,079 | B1 * | 8/2014 | Eubank | A47C 21/022 5/424 |
| 9,044,365 | B2 * | 6/2015 | Rawls-Meehan | A61G 7/015 |
| 9,474,386 | B2 * | 10/2016 | Scarleski | A47C 21/026 |

* cited by examiner

BRACKET FOR RETAINING MATTRESS AND BED EQUIPPED WITH THE SAME

BACKGROUND OF THE INVENTION

1. Field of the Invention

The present invention relates generally to a bracket for retaining a mattress and more particularly, to a conveniently assembled bracket for retaining a mattress, and a bed equipped with the same.

2. Description of the Related Art

A mattress placed on a bed frame might be displaced when receiving an external force. For example, when a user violently exercises or jumps on the mattress, the mattress is displaced little by little. For an electric powered bed frame having an adjustable head portion, the mattress might be displaced toward a foot portion of the bed frame when the head portion is raised. A conventional bracket, which is installed on the bed frame, has a part extending upwards from the bed frame and abutted against a side of the mattress for retaining the mattress. Because the bracket for retaining the mattress has the upwards extending part, a plurality of said bed frames provided with such brackets are difficult to be orderly stacked upon one another, which causes relatively higher cost in transportation and storage. The way of the dealers in the industry for solving the aforesaid problem is that the bracket is not installed on the bed frame beforehand. The bracket will be installed on the bed frame by a consumer after the consumer buys the bed frame along with the bracket. Under this circumstance, the consumer needs tools and skills for assembling the bracket, which causes inconvenience to the consumer.

In other words, the conventional bracket for retaining the mattress is not easily assembled by the user. Therefore, how to provide a conveniently assembled bracket for retaining a mattress is an anxious problem for the dealers in the industry.

SUMMARY OF THE INVENTION

The present invention has been accomplished in view of the above-noted circumstances. It is an objective of the present invention to provide a bracket for retaining a mattress, which is conveniently assembled.

To attain the above objective, the present invention provides a bracket which is adapted to be installed at an edge of a bed frame for retaining a mattress placed on the bed frame. The bracket comprises a fastener and a retainer. The fastener has two wings both located on an imaginary plane, and a convex connected between the two wings and protruded from the imaginary plane. The two wings are adapted to be mounted on a top surface of the bed frame in such a way that the convex defines a passage with the top surface of the bed frame. The convex has a first end and a second end closer to the edge of the bed frame than the first end. The retainer has an inserting portion detachably inserted in the passage, two stop portions extending from an end of the inserting portion in two adverse directions respectively and abutted against the first end of the convex of the fastener, two extending portions extending from the two stop portions respectively, located at two sides of the convex of the fastener respectively and located on the two wings respectively; and at least one retaining portion connected with at least one of the extending portions for being abutted against a side of the mattress.

It is another objective of the present invention to provide a bed which has a conveniently assembled bracket for retaining a mattress.

To attain the above objective, the present invention provides a bed adapted for retaining a mattress placed thereon. The bed comprises a bed frame on which the mattress is placed, and a bracket having a fastener and a retainer. The fastener has two wings both located on an imaginary plane, and a convex connected between the two wings. The two wings are mounted on a top surface of the bed frame. The convex is protruded from the imaginary plane. A passage is provided between the convex and the top surface of the bed frame. The convex has a first end and a second end closer to an edge of the bed frame than the first end. The retainer has an inserting portion, two stop portions, two extending portions, and at least one retaining portion. The inserting portion is detachably inserted in the passage. The two stop portions extend from an end of the inserting portion in two adverse directions respectively, and are abutted against the first end of the convex of the fastener. The two extending portions extend from the two stop portions respectively, and are respectively located at two sides of the convex of the fastener respectively and located on the two wings, respectively. The at least one retaining portion is connected with at least one of the extending portions for being abutted against a side of the mattress.

As a result, the fastener can be installed on the bed frame by the dealer before the bed frame and the bracket are transported to a user. After receiving the bed frame and the bracket, the user only needs to insert the retainer in the fastener, such that the bracket is completely assembled. In this way, the bracket is conveniently and easily assembled by the user without any additional tools and skills.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
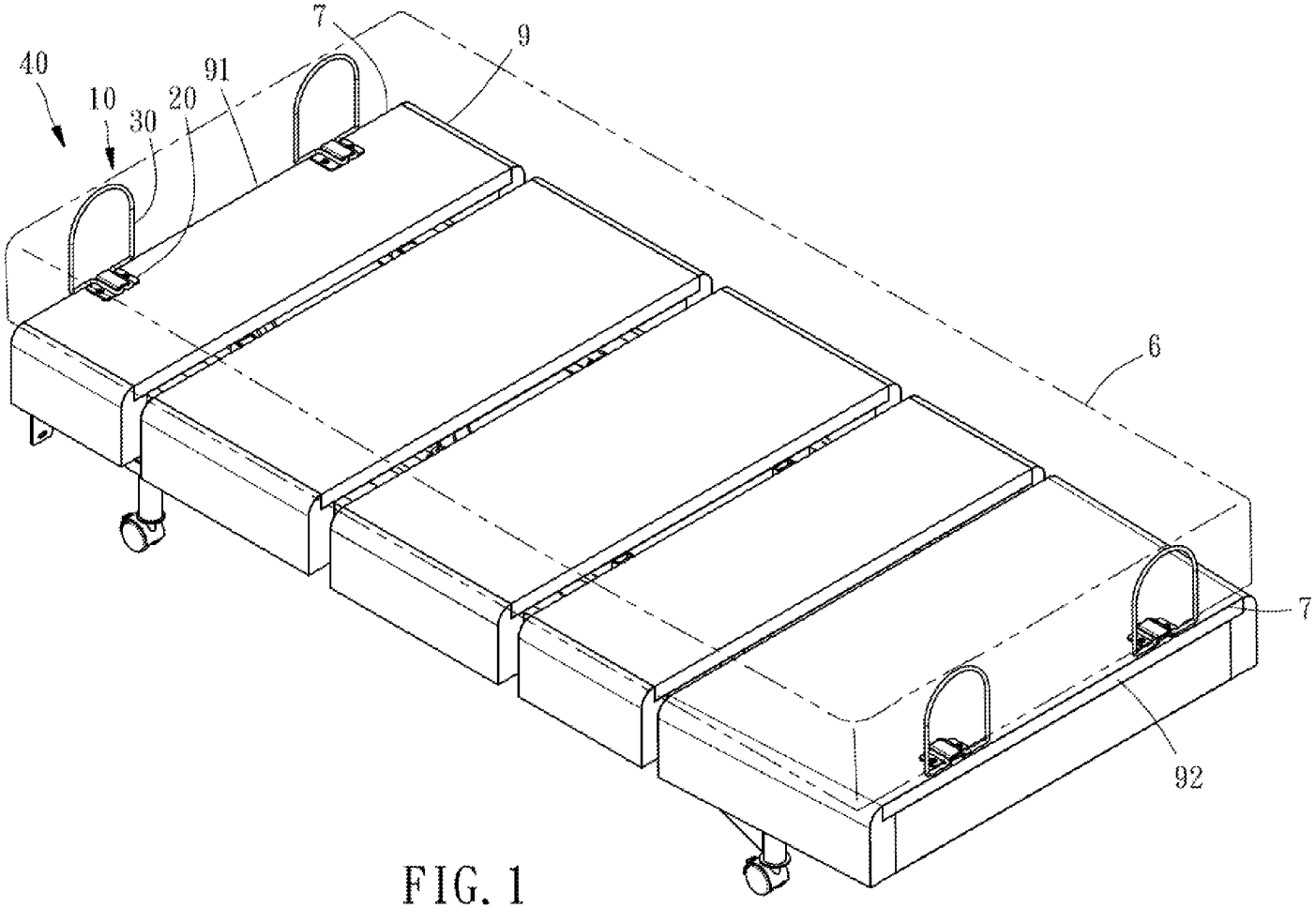
FIG. 1 is a perspective view of a bed according to a preferred embodiment of present invention.

First of all, a bracket for retaining a mattress according to a preferred embodiment of the present invention is illustrated. Referring to FIG. 1, the bracket 10 is installed at an edge 7 of a bed frame 9 and capable of limiting the position of the mattress 6 placed on the bed frame 9. Referring to FIGS. 2-5, the bracket 10 comprises a fastener 20 and a retainer 30.

The fastener 20 has two wings 21 both located on a same imaginary plane, and a convex 22 connecting the two wings 21. The two wings 21 are mounted on a top surface 8 of the bed frame 9. The two wings 21 may be fastened on the top surface 8 of the bed frame 9 by two screws 26, or by other conventional fastening ways such as welding, gluing, wedging, and so on. The convex 22 is protruded from the imaginary plane and defines a passage 23 with the top surface 8 of the bed frame 9. The convex 22 has a first end 24, and a second end 25 closer to the edge 7 of the bed frame 9 than the first end 24.

The retainer 30 has an inserting portion 31, two stop portions 33, two extending portions 34, two expanding portions 35, and a retaining portion 36. The inserting portion 31 is detachably inserted in the passage 23. The inserting portion 31 is composed of two rods 32 abreast with each other. The two stop portions 33 extend in two adverse directions respectively from ends of the two rods 32 respectively, and abutted against the first end 24 of the convex 22 of the fastener 20. The two extending portions 34 extend from the two stop portions 33, respectively. The two extending portions 34 are abutted against two sides of the convex 22 of the fastener 20 respectively, and located on the two wings 21, respectively. The two expanding portions 35 extend from the two extending portions 34 respectively in directions parallel to the edge 7 of the bed frame 9, where the fastener 20 is installed. The retaining portion 36 is inverted U-shaped and has two ends connected with the two expanding portions 35, respectively. The retaining portion 36 is adapted for being abutted against a side of the mattress 6.

Figure 2:
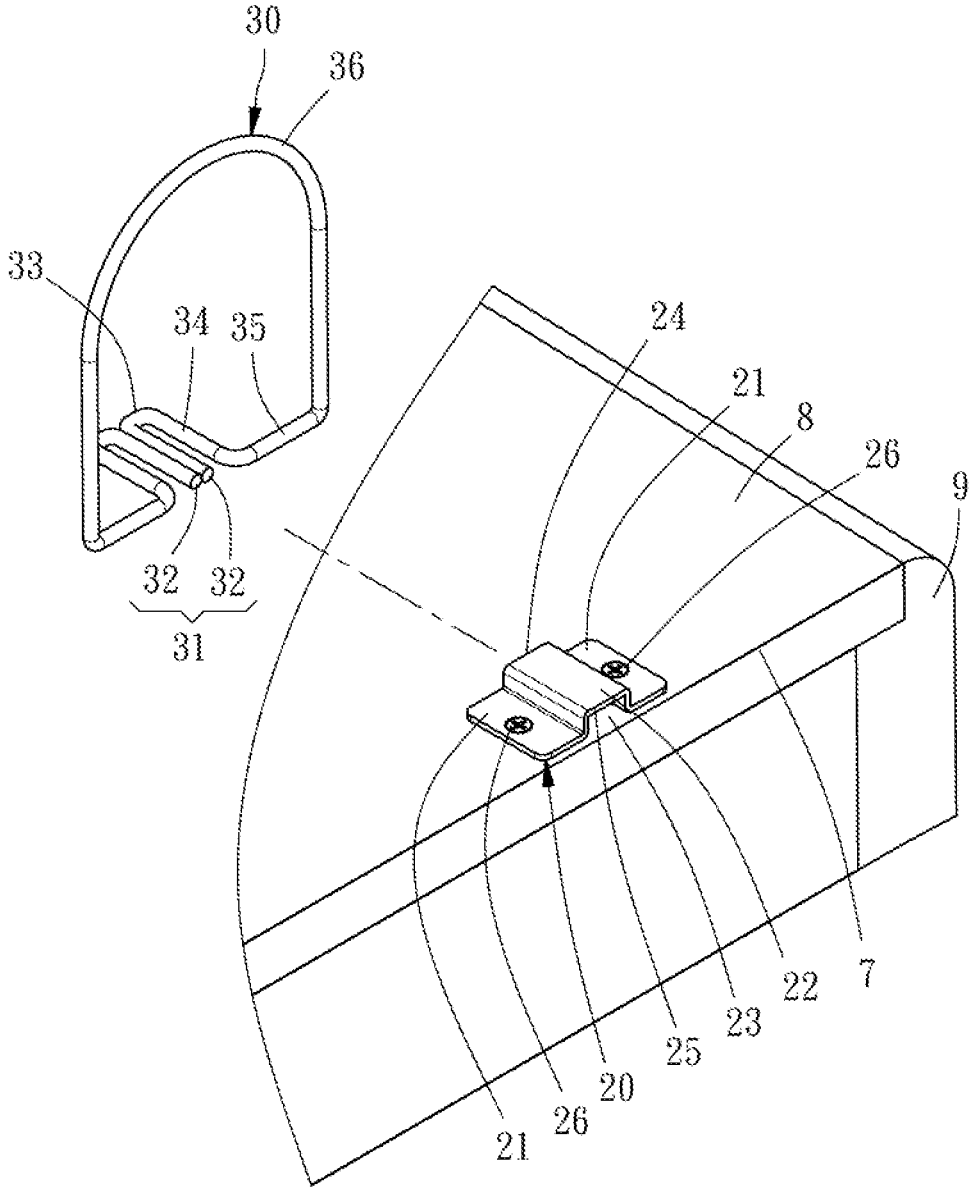
FIGS. 2 and 3 are perspective views showing a process of assembling a bracket for retaining a mattress according to the preferred embodiment of the present invention.
Figure 3:
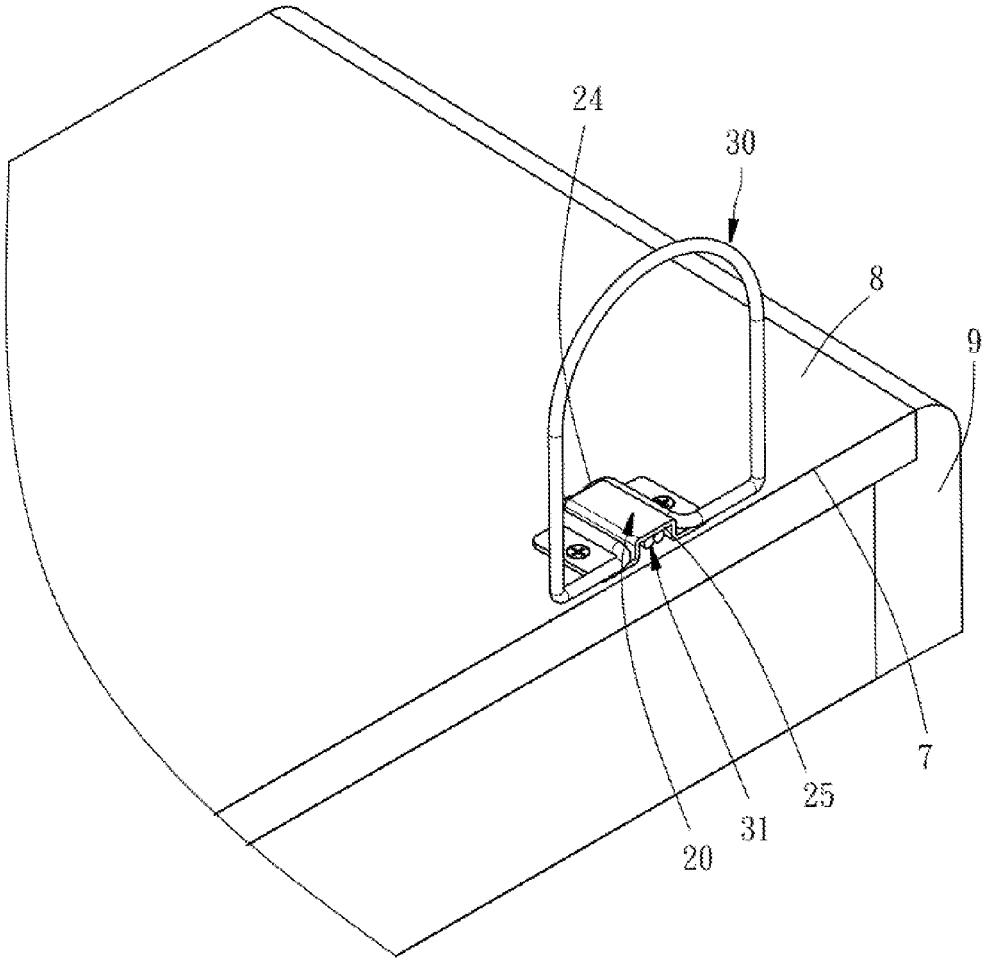
Figure 4:
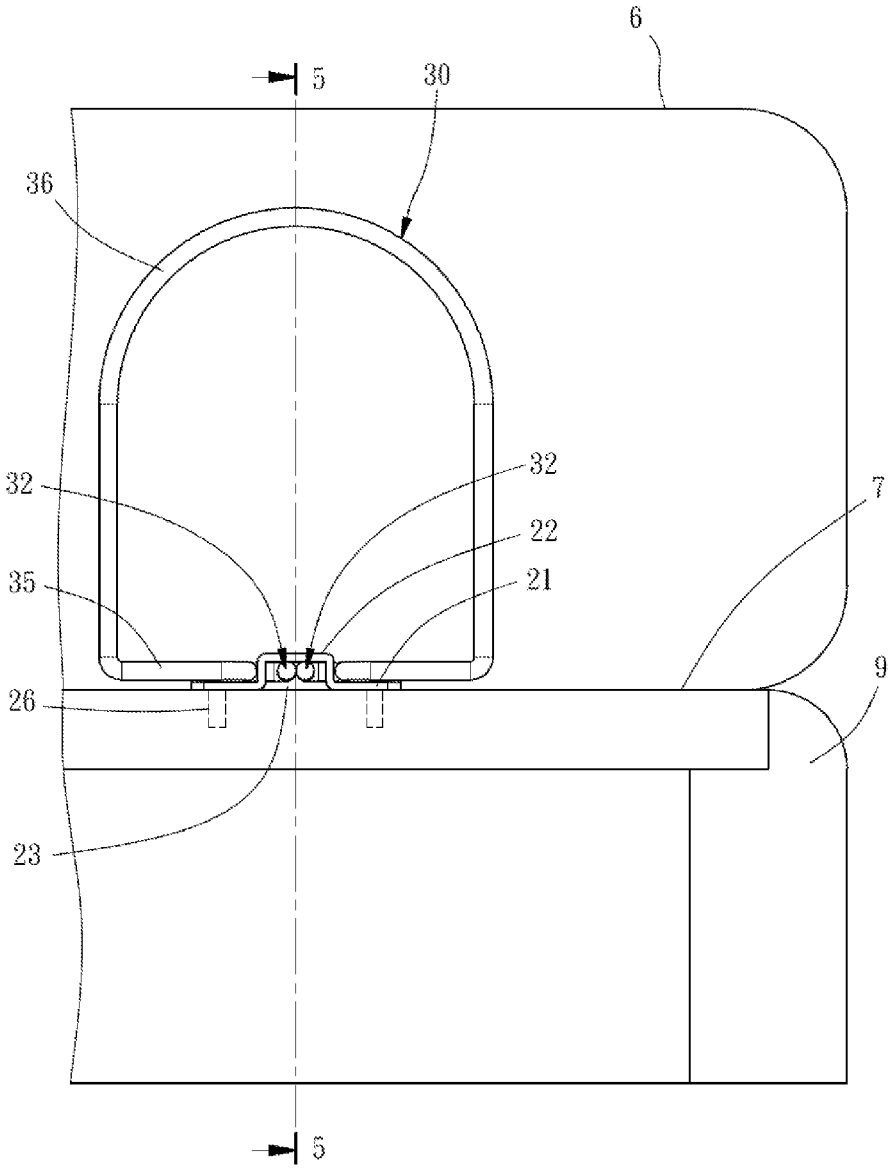
FIG. 4 is a schematic lateral view showing a part of the bed and a mattress according to the preferred embodiment of the present invention.
Figure 5:
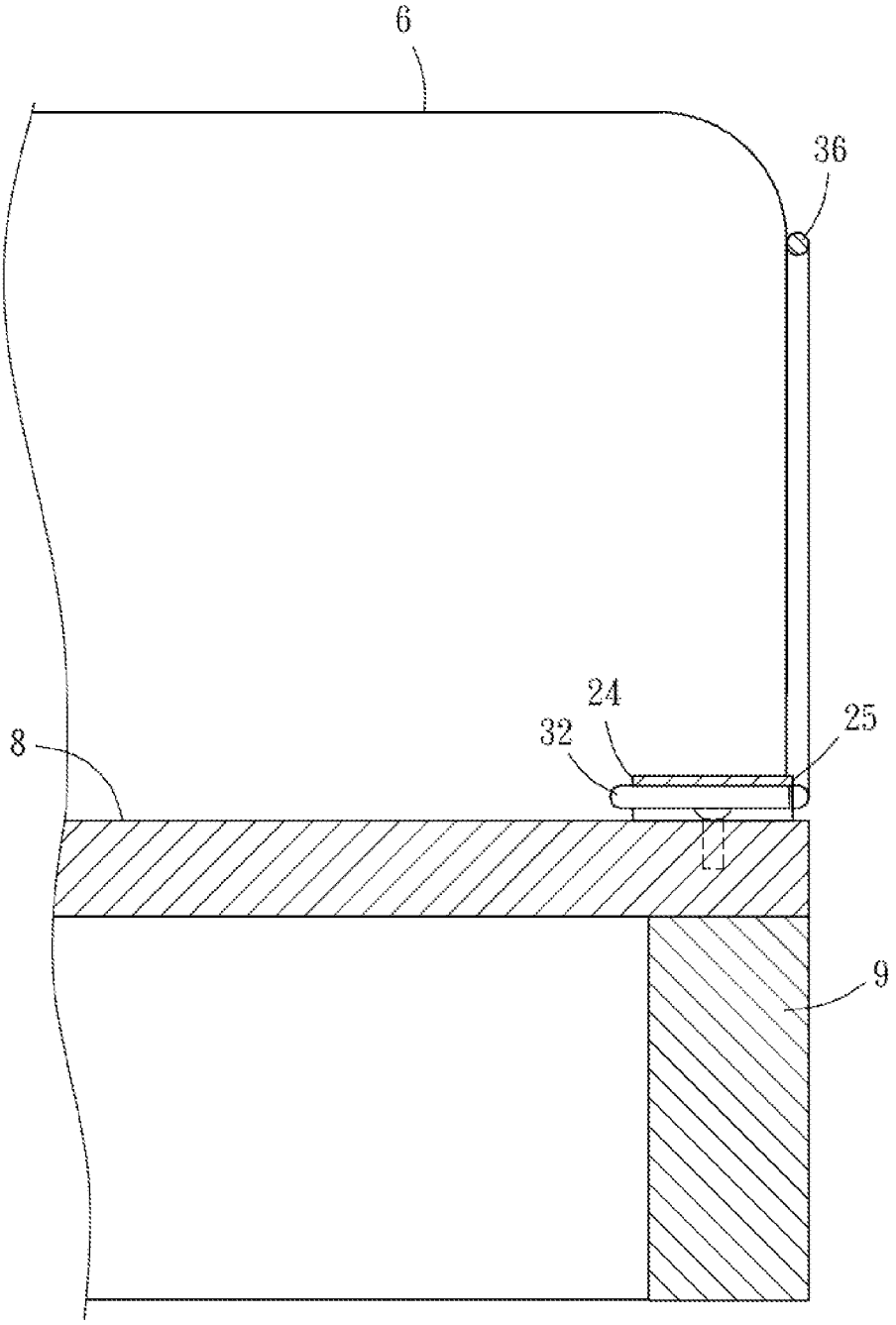
FIG. 5 is a sectional view taken along the line 5-5 in FIG. 4.

The following contents are about the way to assemble the bracket 10 by the user. As shown in FIGS. 2 and 3, the fastener 20 has been installed on the bed frame 9 before the user receives the bed frame 9 along with the bracket 10. The user only needs to insert the inserting portion 31 of the retainer 30 in the passage 23 of the fastener 20 in the direction from the first end 24 to the second end 25 of the convex 22 until the stop portions 33 of the retainer 30 are abutted against the first end 24 of the convex 22, such that the bracket 10 is completely assembled.

In this way, only one step of inserting the retainer to the fastener needs to be performed by the user to assemble the bracket, and the step can be performed without any additional tools and skills. For example, the user doesn't need to align two parts of the retainer and then insert the two parts into two fasteners simultaneously. Therefore, the bracket 10 is positively convenient in assembly.

It is to be mentioned that each expanding portion 35 is provided for lowering the pressure between the retaining portion 36 and the mattress 6. However, the bracket 10 may be provided without any such expanding portion 35 and still capable of being abutted against the side of the mattress 6 for retaining the mattress in position. Besides, each expanding portion 35 is not limited to be parallel to the edge 7 of the bed frame 9, where the fastener 20 is installed. For example, each expanding portion 35 may inclinedly extend relative to the edge 7 to a position distanced from the edge 7. In such circumstance, only the extent that the retainer 30 matches the mattress is influenced, but the bracket 10 is still conveniently assembled.

The feature that the extending portions 34 are abutted against the convex 22 of the fastener 20 enables the retainer 30 to be combined with the fastener 20 stably. However, the extending portions 34 may be not abutted against the convex 22 of the fastener 20 and the bracket, in this case, is still easily assembled. In addition, the inserting portion 31 may be not composed of two rods 32, but shaped as other configurations capable of being inserted in the passage 23, such as a long cube, and the retaining portion 36 may be not inverted U-shaped but shaped as other configurations such as a semicircle.

Figure 6:
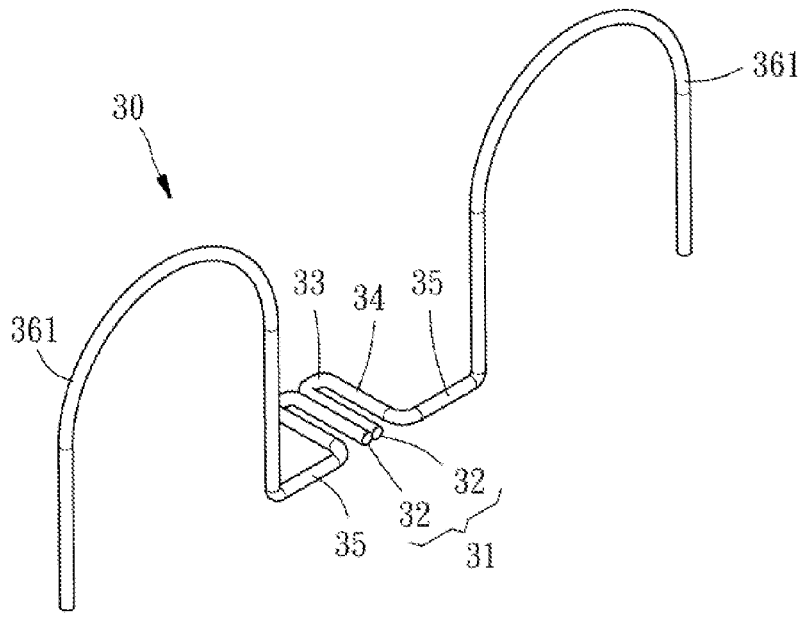
FIG. 6 is a perspective view of a retainer of a bracket for retaining a mattress according to another preferred embodiment of the present invention.

Based on the design concept of the present invention, the retainer 30 of the bracket 10 may be shaped as other configurations, such as a retainer 30 according to another preferred embodiment as shown in FIG. 6. The retainer 30 has same inserting portion 31, stop portions 33, extending portions 34 and expanding portions 35 as mentioned in preceding embodiment, and two retaining portions 361 different from the aforesaid retaining portion 36. The expending portions 35 are connected with ends of the retaining portions 361, respectively. The two retaining portions 361 extend from the two expending portions 35 towards two sides of the bed frame, so the retainer can be abutted against a relatively larger area of the mattress, thereby being more effective in retaining the mattress. It is to be mentioned that the expanding portions 35 may be omitted and the retainer 30 may have only one of the retaining portions 361, which is connected with one of the extending portions 34, and be still effective in retaining the mattress.

Figure 7:
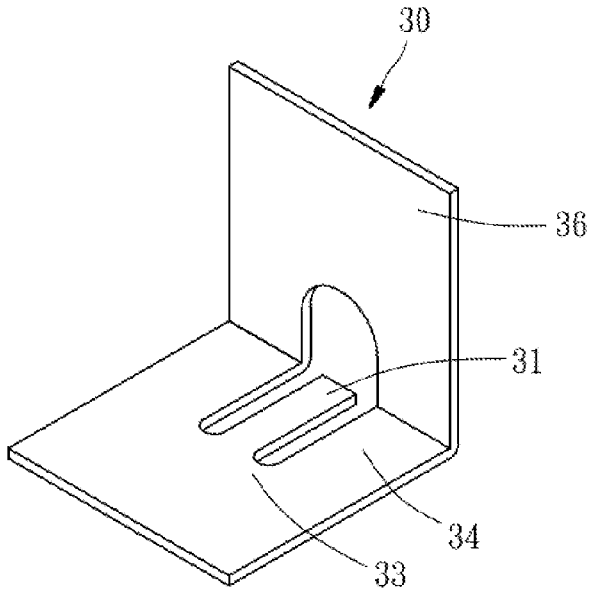
FIG. 7 is a perspective view of a retainer of a bracket for retaining a mattress according to still another preferred embodiment of the present invention.

The retainer 30 of the bracket 10 may be shaped as other configurations, such as a retainer 30 according to still another preferred embodiment as shown in FIG. 7. The retainer 30 is shaped as a bended plate with an opening, and has an inserting portion 31, two stop portions 33, two extending portions 34 and a retaining portion 36. This kind of retainer is more conveniently manufactured and costs lower.

The present invention further provides a bed in the embodiment shown in FIG. 1. The bed 40 is adapted for retaining a mattress 6 placed on the bed 40. The bed 40 comprises a bed frame 9 and four brackets 10 for retaining the mattress. The bed frame 9 is an electric bed frame and has a head portion 91 and a foot portion 92. The bed frame 9 is adapted for supporting the mattress 6 thereon, and the head portion 91 can be raised or the foot portion 92 can be lowered. The structure of each bracket 10 and the possible variations thereof are illustrated above. In this way, the bed 40 in this embodiment has the easily assembled brackets 10 for retaining the mattress.

It is to be mentioned that the bed 40 may comprise only a bed frame 9 and a bracket 10 and can still attain the aforesaid another objective of the present invention. For example, the bracket 10 may be installed at the foot portion 92 for preventing the mattress 6 from sliding down when the head portion 91 swings up.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A bracket for being installed at an edge of a bed frame for retaining a mattress placed on the bed frame, the bracket consisting of:

a fastener having two wings both located on an imaginary plane, and a convex connected between the two wings and protruded from said imaginary plane; the two wings being adapted for being mounted on a top surface of the bed frame in a way that the convex defines a passage with the top surface of the bed frame; the convex having a first end and a second end closer to the edge of the bed frame than the first end; and a retainer having an inserting portion detachably inserted in the passage, two stop portions extending from an end of the inserting portion in two adverse directions respectively and abutted against the first end of the convex of the fastener, two extending portions extending from the two stop portions respectively, located at two sides of the convex of the fastener respectively and located on the two wings respectively, at least one retaining portion connected with at least one of the extending portions for being abutted against a side of the mattress, and two expanding portions each connected between one said extending portion and one said retaining portion, the expanding portions extending in a horizontal direction parallel to the edge between the top surface and a side surface of the bed frame where the fastener is installed.

2. The bracket as claimed in claim 1, wherein the retainer has one said retaining portion having two ends connected with the two extending portions, respectively.

3. The bracket as claimed in claim 1, wherein the retainer has two said retaining portions connected with the two extending portions, respectively.

4. The bracket as claimed in claim 1, wherein the inserting portion is composed of two rods abreast with each other; the two stop portions extend in the two adverse directions from ends of the two rods, respectively.

5. The bracket as claimed in claim 1, wherein the extending portions of the retainer are abutted against the convex of the fastener.

6. A bed for retaining a mattress placed thereon, the bed comprising:

a bed frame for supporting the mattress thereon; and a bracket consisting of a fastener and a retainer, wherein the fastener has two wings both located on an imaginary plane, and a convex connected between the two wings; the two wings are mounted on a top surface of the bed frame; the convex is protruded from said imaginary plane in a way that a passage is provided between the convex and the top surface of the bed frame; the convex has a first end and a second end closer to an edge of the bed frame than the first end; the retainer has an inserting portion, two stop portions, two extending portions, at least one retaining portion and two expanding portions; the inserting portion is detachably inserted in the passage; the two stop portions extend from an end of the inserting portion in two adverse directions respectively, and are abutted against the first end of the convex of the fastener; the two extending portions extend from the two stop portions respectively, and are located at two sides of the convex of the fastener respectively and located on the two wings respectively; the at least one retaining portion is connected with at least one of the extending portions for being abutted against a side of the mattress; the expanding portions each are connected between one said extending portion and one said retaining portion; the expanding portions extend in a horizontal direction parallel to the edge between the top surface and a side surface of the bed frame where the fastener is installed.

7. The bed as claimed in claim 6, wherein the retainer has one said retaining portion having two ends connected with the two extending portions, respectively.

8. The bed as claimed in claim 6, wherein the retainer has two said retaining portions connected with the two extending portions, respectively.

9. The bed as claimed in claim 6, wherein the inserting portion is composed of two rods abreast with each other; the two stop portions extend in the two adverse directions from ends of the two rods, respectively.

10. The bed as claimed in claim 6, wherein the extending portions of the retainer are abutted against the convex of the fastener.

* * * * *